US005488327A

United States Patent [19]

Okada

[11] Patent Number: 5,488,327

[45] Date of Patent: Jan. 30, 1996

[54] SUPPLY VOLTAGE GENERATOR

[75] Inventor: Masaki Okada, Kasugai, Japan

[73] Assignees: Fujitsu Limited, Kanagawa; Fujitsu VLSI Limited, Aichi, both of Japan

[21] Appl. No.: 365,432

[22] Filed: Dec. 28, 1994

[30] Foreign Application Priority Data

Dec. 28, 1993 [JP] Japan ..... 5-334973

[51] Int. Cl.[6] ..... G05F 1/10; G05F 3/02

[52] U.S. Cl. ..... 327/536; 327/530; 327/535; 327/538

[58] Field of Search ..... 327/535, 536, 327/538, 589, 332, 323, 530; 326/34

[56] References Cited

U.S. PATENT DOCUMENTS 5,003,197 3/1991 Nojima et al. ..... 327/536
5,365,121 11/1994 Morton et al. ..... 327/536

*Primary Examiner*—Timothy P. Callahan

*Assistant Examiner*—Jung Ho Kim

*Attorney, Agent, or Firm*—Nikaido, Marmelstein, Murray & Oram

[57] ABSTRACT

Disclosed is a circuit which receives a supply voltage from a power supply and generates a voltage of a desired level different from that of the supply voltage. The circuit includes an oscillation circuit, a supply voltage generator, a first interconnection and a control circuit. The oscillation circuit generates an oscillation output signal. The supply voltage generator is responsive to the oscillation output signal from the oscillation circuit and generates a voltage of a predetermined level. The first interconnection connects the supply voltage generator to an internal circuit which is to be supplied with the voltage generated by the supply voltage generator. The internal circuit is also connected via a second interconnection to a power supply. The control circuit is provided between the first interconnection and the second interconnection as a variable resistor circuit which is responsive to the oscillation output signal from the oscillation circuit. The control circuit changes its resistance in synchronism with the end of the generation of the voltage of the predetermined level by the supply voltage generator.

12 Claims, 6 Drawing Sheets

Fig. 1
(PRIOR ART)
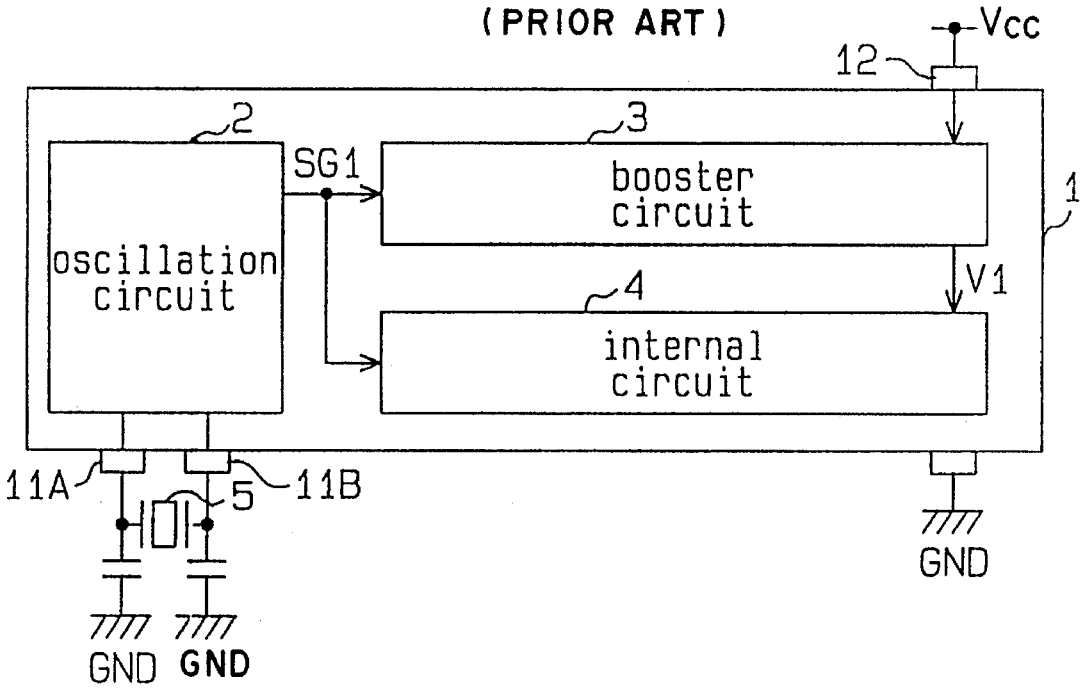
Fig. 2a
(PRIOR ART)
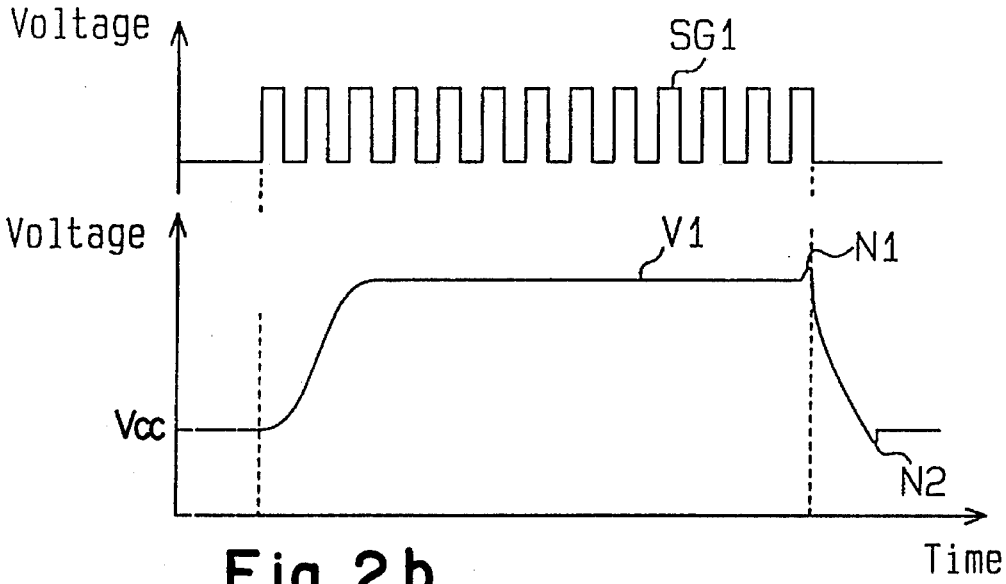
Fig. 2b
(PRIOR ART)

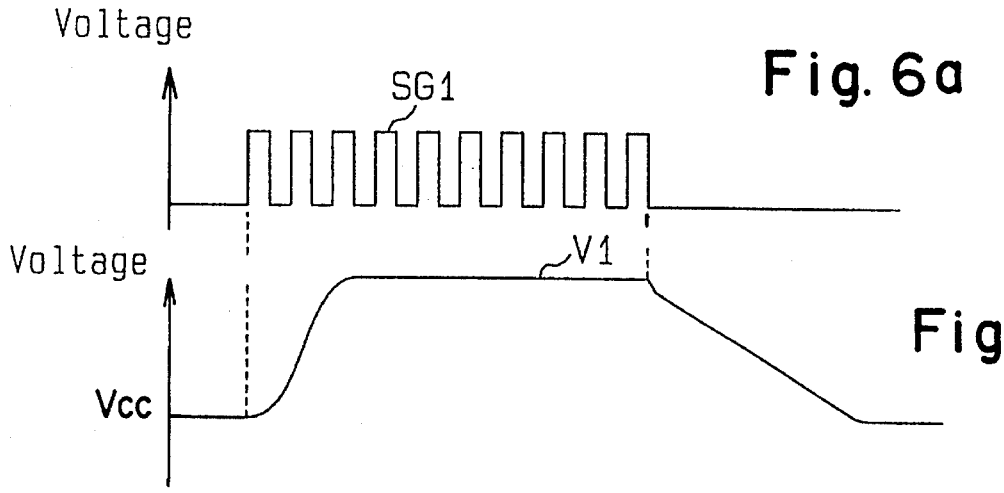
Fig. 6a
Fig. 6b
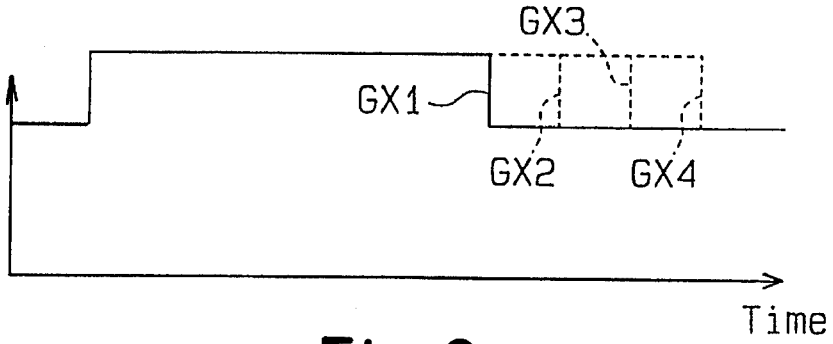
Fig. 6c
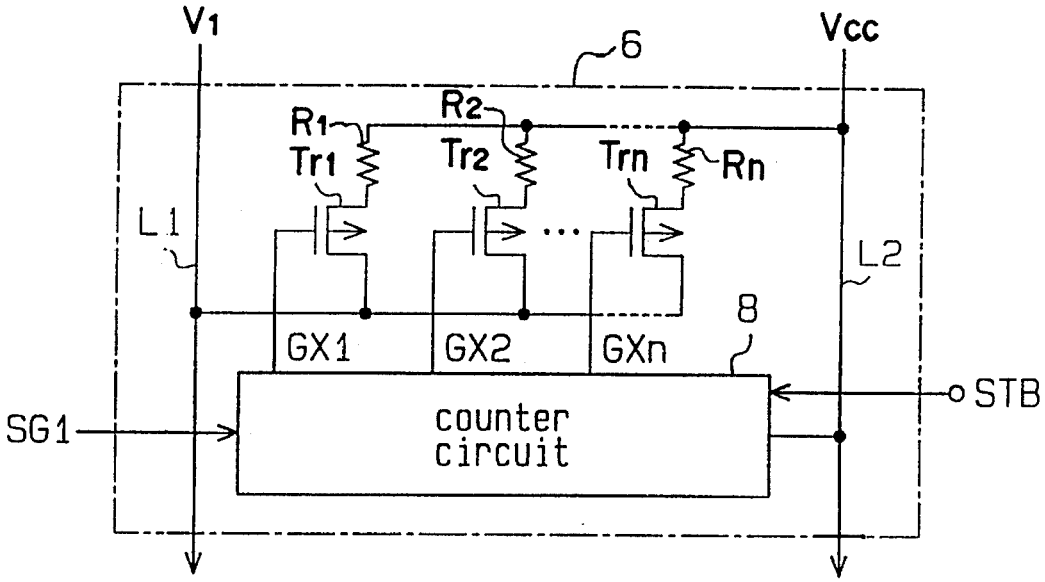
Fig. 7

SUPPLY VOLTAGE GENERATOR

BACKGROUND OF THE INVENTION

1. Field of the Invention

The present invention relates generally to a supply voltage generator for supplying a predetermined voltage to the internal circuits of a semiconductor device, and a semiconductor device equipped with the supply voltage generator.

2. Description of the Related Art

Some recent semiconductor devices have internal circuits which have been designed to consume less power and/or requiring various levels, such as a high voltage level and a negative voltage level, which are incorporated in a supply voltage generator. The supply voltage generator generates a desired voltage from the supply voltage applied to its external terminals, and supplies the generated voltage to the internal circuits. In such a semiconductor device, for example, when voltage application to the supply voltage generator becomes unnecessary for the purpose of reducing the consumed power, the supply voltage generator is designed so as to stop its operation.

FIG. 1 shows one example of a semiconductor device incorporating a conventional supply voltage generator. Provided on a chip 1 are an oscillation circuit 2, a booster circuit 3 and an internal circuit 4. The oscillation circuit 2 and the booster circuit 3 constitute the supply voltage generator.

The oscillation circuit 2 is connected via a pair of external terminals 11A and 11B to a crystal oscillator 5. From a reference frequency signal output from the crystal oscillator 5, the oscillation circuit 2 generates a desired oscillation output signal SG1 as shown in FIG. 2. The oscillation output signal SG1 is supplied to the booster circuit 3 and the internal circuit 4.

The booster circuit 3 is a known circuit which comprises capacitors and switching elements (neither shown). The booster circuit 3 is supplied with power from a power supply $V_{cc}$ through an external terminal 12 on the chip 1, and generates an output voltage V1 higher than the supply voltage $V_{cc}$ (see FIG. 2), in response to the oscillation output signal SG1. The output voltage V1 is set in accordance with the frequency of the oscillation output signal SG1. In response to the beginning of the oscillation of the signal SG1, the booster circuit 3 boosts the output voltage V1 to a predetermined level. The voltage to the internal circuit 4 is supplied by the supply voltage $V_{cc}$ through the output voltage V1, and executes a predetermined operation in response to the signal SG1.

When supply of the high-level output voltage V1 becomes unnecessary, the oscillation of the output signal SG1 from the oscillation circuit 2 is stopped and the booster circuit 3 stops the boosting operation in order to reduce the consumed power of the semiconductor device. As a result, the output voltage V1 drops to reach (or approach) the level of the supply voltage $V_{cc}$ in accordance with the gate capacitance or the junction capacitance of the transistors constituting a buffer circuit in the booster circuit 3.

When the output voltage V1 drops due to the termination of the oscillation signal SG1, noise N1 occurs on the output voltage V1 as shown in FIG. 2. When the output voltage V1 falls to the level of the supply voltage $V_{cc}$, noise N2 likewise appears on the output voltage V1. The presence of noise N1 and N2 is undesirable since they may cause the internal circuit 4 to malfunction.

To prevent malfunction caused by noises N1 and N2, various measures have been taken. One measure is to increase the distance between the booster circuit 3 and the internal circuit 4 and increase the length of the interconnection between both circuits. Another is to provide a noise removing diode between both circuits 3 and 4.

Increasing the distance between the booster circuit 3 and the internal circuit 4 however results in a larger chip area. The noise removing effect that is provided by the intervention of a noise removing diode between the booster circuit 3 and the internal circuit 4 depends on the characteristics of that diode and the transistors constituting the booster circuit 3. The noise removing diode alone could not therefore prevent the internal circuit from malfunctioning from the noises N1 and N2.

SUMMARY OF THE INVENTION

Accordingly, it is a primary objective of the present invention to provide a supply voltage generator capable of preventing the occurrence of noise as much as possible even when the voltage generated by the supply voltage generator itself varies.

To achieve the foregoing and other objects and in accordance with the purpose of the present invention, an improved supply voltage generator is provided, which includes by reference to the following description taken in conjunction with the following figures.

FIG. 3 shows a circuit which receives a supply voltage from a power supply and generates a voltage of a desired level different from that of the supply voltage. The circuit includes an oscillation circuit 2, a supply voltage generator 3, a first interconnection L1 and a control circuit 6. The oscillation circuit 2 generates an oscillation output signal SG1. The supply voltage generator 3 is responsive to the oscillation output signal SG1 from the oscillation circuit 2 and generates a voltage V1 of a predetermined level in response to the oscillation output signal SG1. The first interconnection L1 connects the supply voltage generator 3 to an internal circuit 4 which is supplied with the voltage V1 generated by the supply voltage generator 3. The internal circuit 4 is connected via a second interconnection L2 to a power supply. The control circuit 6 is provided between the first interconnection L1 and the second interconnection L2 as a variable resistor circuit which varies as a function of the oscillation output signal SG1 from the oscillation circuit 2. The control circuit 6 changes its resistance in synchronism with the end of the generation of the voltage V1 from the predetermined level set by the supply voltage generator 3.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings.

FIG. 1 is a block diagram illustrating a conventional supply voltage generator and a semiconductor device incorporating the same;

FIG. 2 is a waveform diagram illustrating the operation of the supply voltage generator in FIG. 1;

FIG. 6 is a waveform diagram illustrating the operation of this embodiment; and FIGS. 7, 8 and 9 are circuit diagrams showing potential control circuits according to another embodiments.

DETAILED DESCRIPTION OF THE PREFERRED EMBODIMENTS

Figure 3:
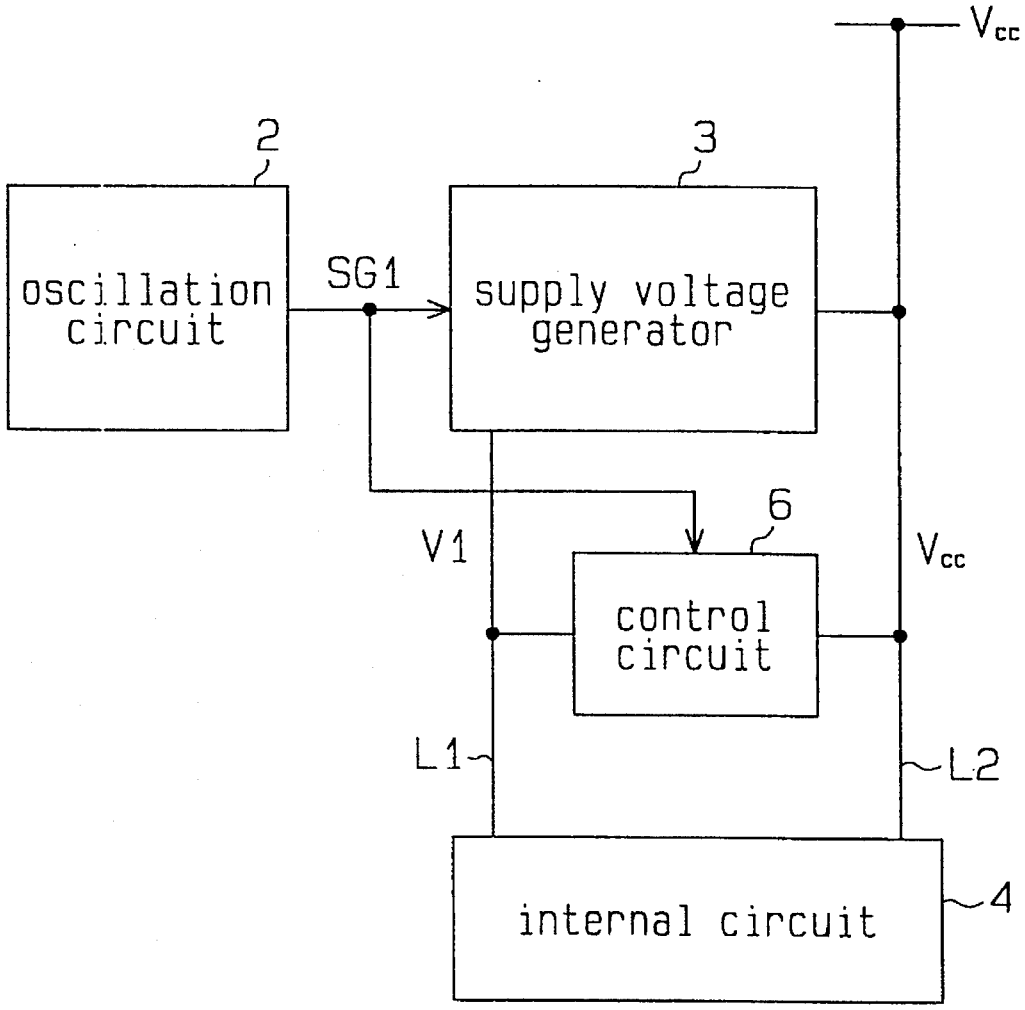
FIG. 3 is a schematic diagram showing the outline of the present invention.
Figure 4:
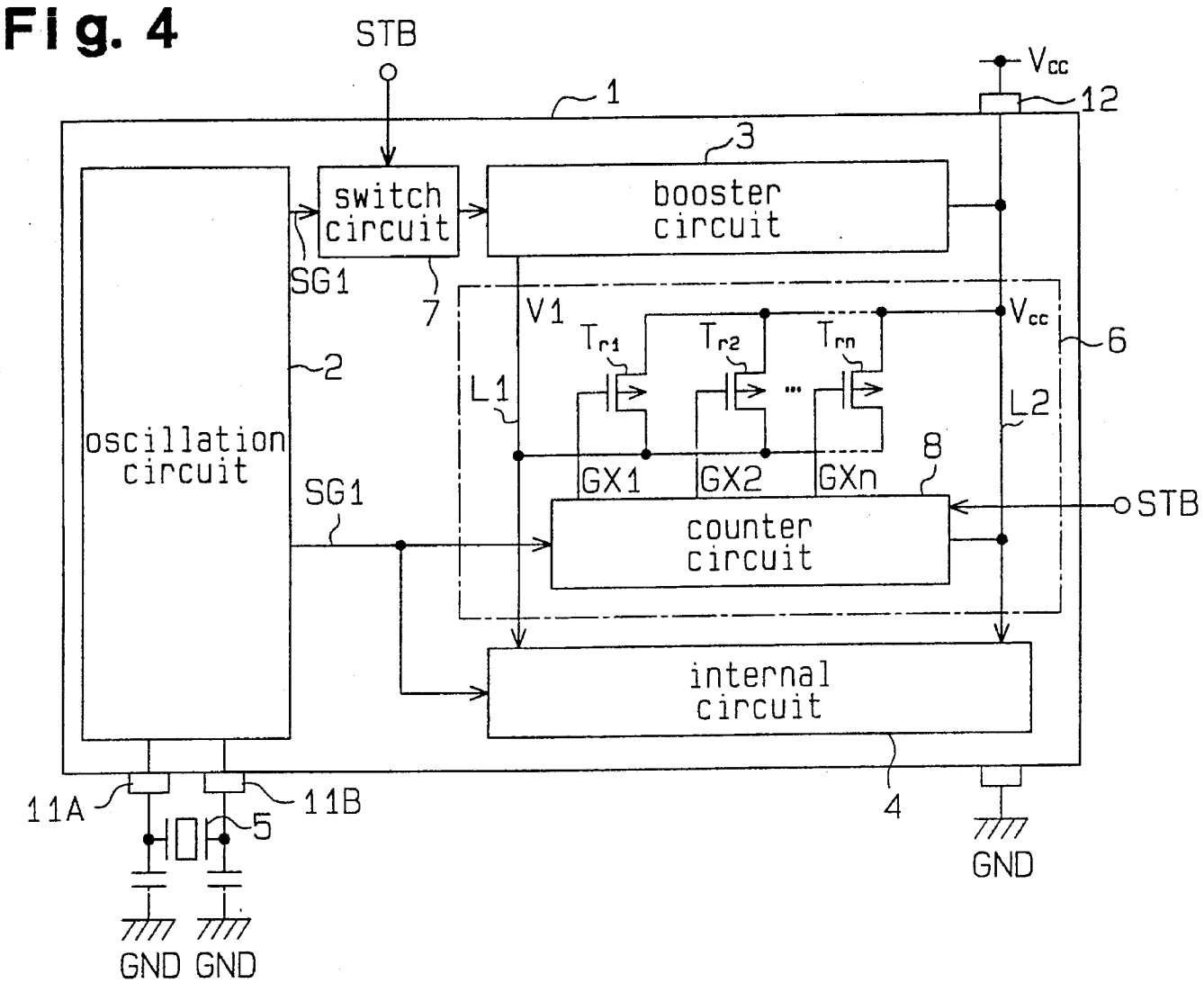
FIG. 4 is a schematic diagram showing a semiconductor device according to one embodiment of this invention.

A semiconductor device according to one embodiment of the present invention will be described below with reference to FIGS. 4 through 6. In this embodiment, the present invention is adapted for a semiconductor device as shown in FIG. 4. Like or same reference numerals as used in the prior art figures are also given to corresponding or identical components of this embodiment of the present invention.

Provided on a chip 1 is an oscillation circuit 2, a booster circuit 3, an internal circuit 4, a potential control circuit 6 and a switch circuit 7. The oscillation circuit 2, the booster circuit 3, the potential control circuit 6, and the switch circuit 7 constitute a supply voltage generator.

A crystal oscillator 5 is connected to the oscillation circuit 2 via external terminals 11A and 11B. From a reference frequency signal output from the crystal oscillator 5, the oscillation circuit 2 generates a oscillation output signal SG1 as shown in FIG. 6.

The oscillation output signal SG1 of the oscillation circuit 2 of FIG. 4 is supplied to the booster circuit 3 via the switch circuit 7, to the internal circuit 4, and to the potential control circuit 6 directly. The booster circuit 3, like the known booster circuit of the prior art, comprises capacitors and switching elements. The booster circuit 3 is supplied with power from a power supply $V_{cc}$ through an external terminal 12, and generates an output voltage V1 higher than a supply voltage $V_{cc}$ (see FIG. 6), in response to the oscillation output signal SG1. The booster circuit 3 supplies the output voltage V1 to the internal circle 4 via an output line L1. The output voltage V1 is a function of the frequency of the oscillation output signal SG1. As shown in FIG. 6, the booster circuit 3 boosts the output voltage V1 in response to the beginning of the oscillation of the signal SG1.

The switch circuit 7 receives a strobe signal STB from an external circuit (not shown) and opens in response to this strobe signal STB.

The potential control circuit 6 has a counter circuit 8 and a plurality of P channel MOS transistors Tr1, Tr2, . . . , and Trn. Count signals GX1 to GXn from the counter circuit 8 are respectively input to the gates of the individual transistors Tr1 to Trn. As shown in FIG. 4, the counter circuit 8 is supplied with the supply voltage $V_{cc}$ via a power line L2.

The transistors Tr1–Trn each have a source connected to the output line L1, and a drain connected to the power line L2 for supplying the supply voltage $V_{cc}$ to the internal circuit 4, and are connected in parallel. The individual transistors Tr1–Trn are configured in such a way as to be turned on in response to the associated count signals GX1–GXn of an L level and to serve as a high resistor when turned on.

Figure 5:
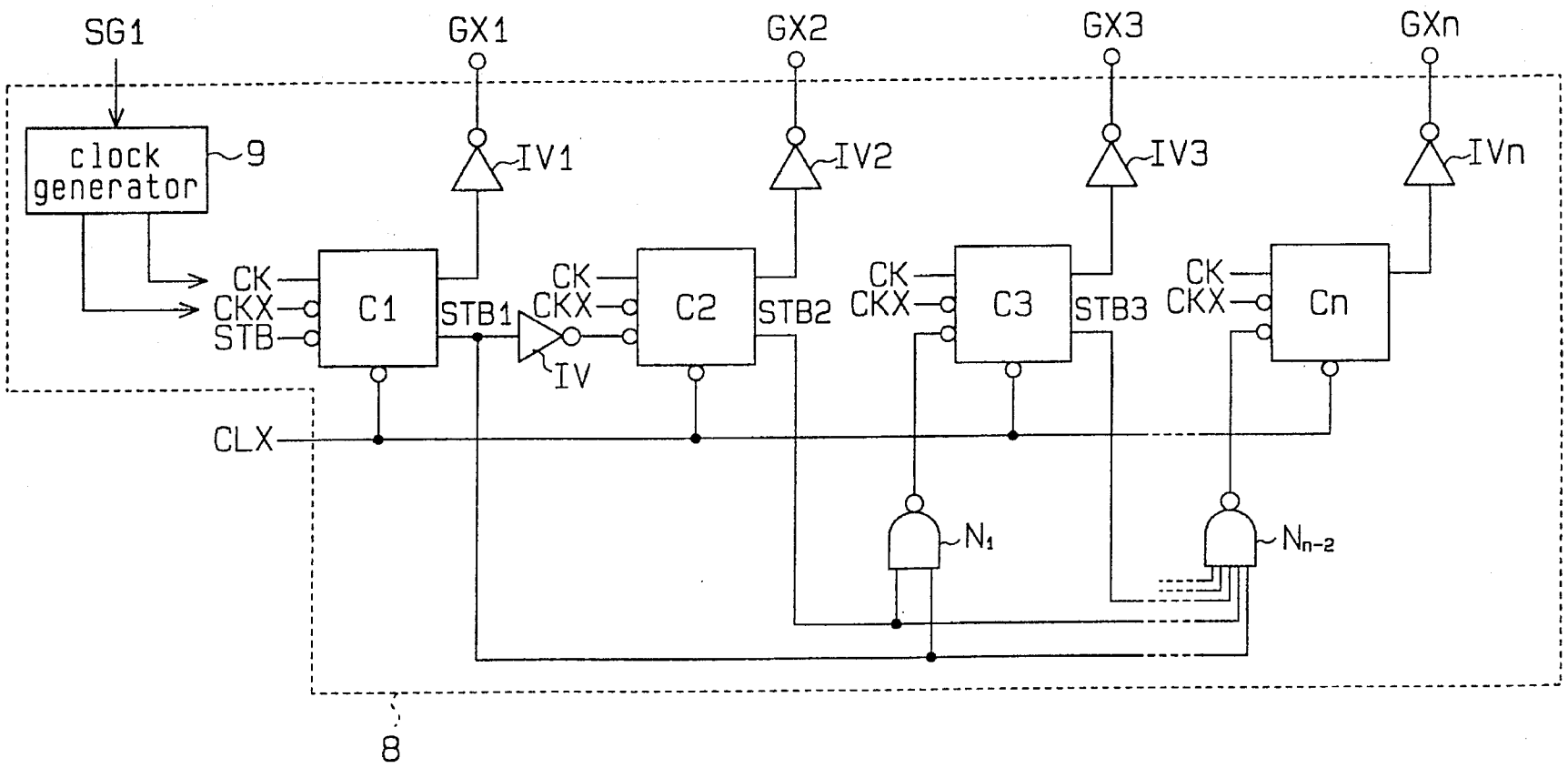
FIG. 5 is a circuit diagram showing a counter circuit.

FIG. 5 shows the detailed structure of the counter circuit 8. The counter circuit 8 has a plurality of counter cells C1 to Cn and a plurality of inverter circuits IV1 to IVn associated with the counter cells C1–Cn. The counter circuit 8 further includes a plurality of NAND gates $N_1$ to $N_{n-2}$ associated with the other counter cells (C3–Cn) than the first and second counter cells C1 and C2, and a clock generator 9. The first NAND gate $N_1$ receives two signals and the NAND gate $N_{n-2}$ receives (n–1) signals. An inverter circuit IV is provided between the counter cells C1 and C2.

The clock generator 9 produces a clock signal CK and an inverted clock signal CKX in response to the oscillation output signal SG1 from the oscillation circuit 2. Each of the counter cells C1–Cn is composed of a known flip-flop circuit, and receives the clock signals CK and CKX. When detecting one pulse of the clock signal CK and one pulse of the clock signal CKX, the individual counter cells C1–Cn output H-level output signals to the associated inverter circuits IV1–IVn.

The inverter circuits IV1–IVn invert the H-level output signals from the associated counter cells C1–Cn and output L-level count signals GX1–GXn. In other words, the individual counter cells C1–Cn respectively output the L-level count signals GX1–GXn in synchronism with the reception of the 1-pulse clock signal CKX.

The strobe signal STB is input to the counter cell C1 at the first stage from an external circuit not shown (e.g., a central processing unit). When the strobe signal STB becomes an L level from an H level, the counter cell C1 starts counting the clock signals CK and CKX. The counter cell Cl outputs an H-level secondary strobe signal STB1 to the inverter circuit IV and the NAND gates $N_1$–$N_{n-2}$ in synchronism with the reception of the 1-pulse clock signal CK and the 1-pulse clock signal CKX.

The H-level strobe signal STB1 is inverted to have an L level by the inverter circuit IV, and the resultant signal is input to the counter cell C2. The counter cell C2 starts the counting operation when the strobe signal STB1 becomes an H level from the L level.

The counter cell C2 outputs an H-level ternary strobe signal STB2 to the NAND gates $N_1$–$N_{n-2}$ in synchronism with the reception of the 1-pulse clock signal CK and the 1-pulse clock signal CKX.

When the strobe signals STB1 and STB2 both become an H level, the first NAND gate $N_1$ outputs an L-level signal to the counter cell C3. The counter cell C3 starts the counting operation when the strobe signals STB1 and SB2 both become an H level. The counter cell C3 outputs an H-level quaternary strobe signal STB3 to the NAND gates $N_2$–$N_{n-2}$ in synchronism with the reception of the 1-pulse clock signal CK and the 1-pulse clock signal CKX.

The NAND gate $N_{n-2}$ associated with the n-th counter cell Cn receives the strobe signals STB1 to STBn-1 output from the counter cells C1 to Cn–1. When the strobe signals STB1 to STBn-1 all become an H level, the NAND gate $N_{n-2}$ outputs an L-level signal to the counter cell Cn. The counter cell Cn starts the counting operation when the strobe signals STB1 to SBn–1 all become an H level.

Through the above operation, when receiving the strobe signal STB, the counter circuit 8 sequentially outputs the L-level count signals GX1–GXn in synchronism with the reception of the 1-pulse clock signal CK and the 1-pulse clock signal CKX. The counter cells C1-Cn are supplied with a reset signal CLX and reset their output signals when the reset signal CLX becomes an L level from an H level.

With the supply voltage $V_{cc}$ supplied to this semiconductor device, when the oscillation circuit 2 outputs the oscillation output signal SG1, the booster circuit 3 starts the boosting operation in response to the oscillation output signal SG1 to boost the output voltage V1 to a predetermined level from the level of the supply voltage $V_{cc}$. Then, the output voltage V1 of the booster circuit 3 and the supply voltage $V_{cc}$ are used to supply the internal circuit 4, permitting the internal circuit 4 to operate.

When the supply of the output voltage V1 to the internal circuit 4 from the booster circuit 3 becomes unnecessary, the strobe signal STB is externally input both to the switch circuit 7 and the counter circuit 8. As a result, the switch circuit 7 is opened, inhibiting the supply of the oscillation output signal SG1 to the booster circuit 3. This stops the boosting operation. At the same time, the counter circuit 8 starts the counting operation.

During counting, the counter circuit 8 sequentially outputs the L-level count signals GX1–GXn (n=4 in this case) as shown in FIG. 6. In response to the count signals GX1–GXn, the transistors Tr1 to Trn (n=4 in this example) are sequentially turned on in a high impedance state. As the number of transistors which make the output line L1 and the power line L2 electrically conductive increases, the resistance of the parallel transistor circuit between the output line L1 and the power line L2 sequentially decreases and the output voltage V1 gradually falls down to the level of the supply voltage $V_{cc}$. This prevents noise from occurring with the reduction in output voltage V1.

Therefore, when the supply of the output voltage V1 to the internal circuit 4 becomes unnecessary, the output voltage V1 gradually falls down to the level of the supply voltage $V_{cc}$, thus preventing the occurrence of noise. This can prevent the internal circuit 4 from malfunctioning due to the noise.

Although only one embodiment of the present invention has been described herein, it should be apparent to those skilled in the art that the present invention may be embodied in many other specific forms without departing from the spirit or scope of the invention. Particularly, it should be understood that the present invention may be worked out in the following forms.

In place of the P channel MOS transistors Tr1–Trn, which are turned on in a high impedance state in response to the L-level count signals GX1–GXn, P channel MOS transistors Tr1–Trn as switching elements which are turned on in a low impedance state may be connected in series to associated resistors R1 to Rn as shown in FIG. 7.

The P channel MOS transistors Tr1–Trn may be replaced with N channel MOS transistors. In this case, H-level count signals higher than the output voltage V1 should be output to the individual gates to turn each N channel MOS transistor on.

Figure 8:
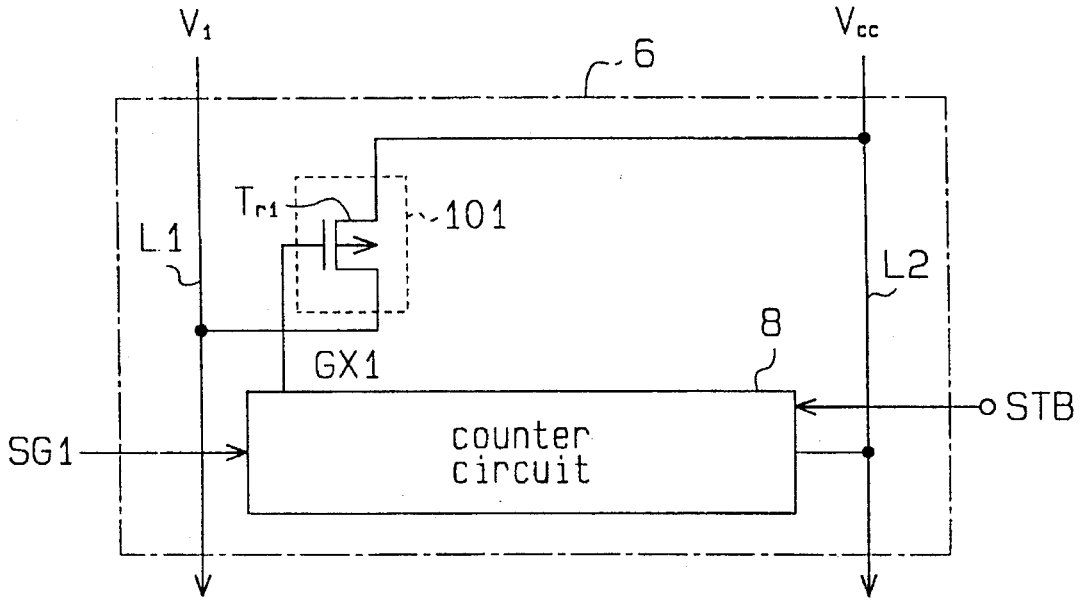

As shown in FIG. 8, a potential control circuit 6 may be formed by the counter circuit 8 and only one transistor Tr1. The transistor Tr1 serves as a time constant circuit 101 with a CR time constant defined by the capacitance of itself and the resistance when turned on. The CR time constant should be set to a value to gradually reduce the potential difference between the lines L1 and L2.

Figure 9:
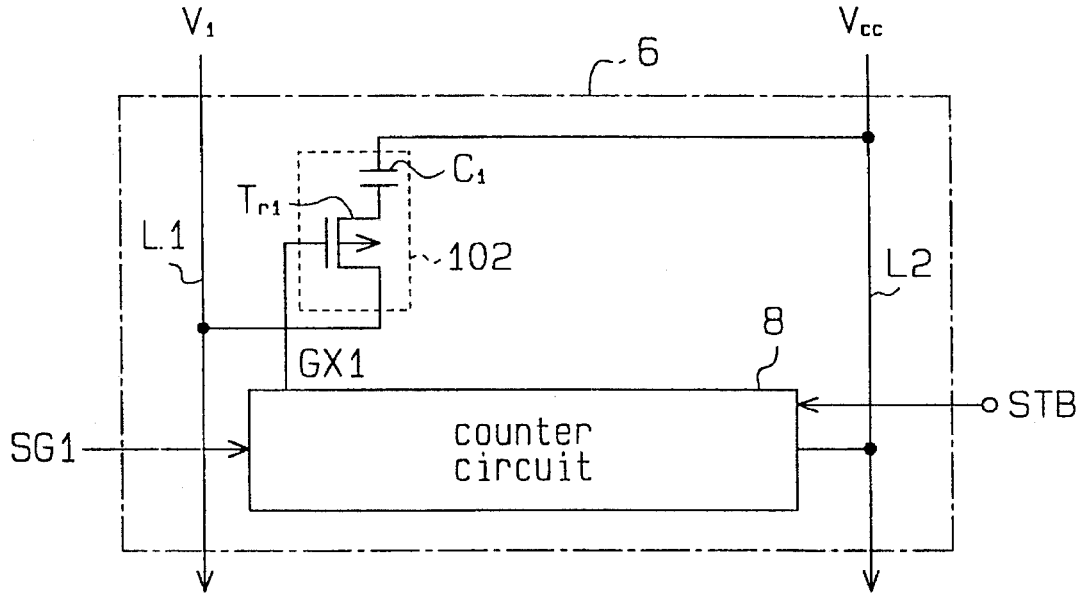

As shown in FIG. 9, the potential control circuit 6 may further include a capacitor C1 as a capacitance element connected between the drain of the transistor Tr1 and the power line L2 having a lower voltage level than that of the output line L1. The transistor Tr1 and the capacitor C1 forms a time constant circuit 102, which has a CR time constant defined by the capacitance of the capacitor C1 and the resistance when Tr1 turned on. The capacitor C1 may be located between the output line L2 and the source of the transistor Tr1.

Therefore, the present examples and embodiment are to be considered as illustrative and not restrictive and the invention is not to be limited to the details given herein, but may be modified within the scope of the appended claims.

What is claimed is:

1. A circuit for receiving a supply voltage from a power supply and generating an output voltage having a desired voltage level that is different from the supply voltage, said circuit comprising:

an oscillator for generating an oscillator output signal;

a supply voltage generator for generating an output voltage having a predetermined level that is different than said supply voltage in response to said oscillator output signal;

a first interconnection for connecting said supply voltage generator to a circuit to be supplied with said output voltage, said circuit being connected to the power supply via a second interconnection; and a potential difference control circuit provided between said first interconnection and said second interconnection, the control circuit being responsive to said oscillator output signal to gradually reduce a potential difference between said first interconnection and said second interconnection in synchronism with a change in the output voltage.

2. The circuit according to claim 1, wherein said control circuit comprises:

a counter circuit for counting pulses of said oscillator output signal, said counter circuit starting a counting operation in response to a strobe signal input when the output voltage of the supply voltage generator is to be changed from the predetermined level, and sequentially outputting a count signal every time a predetermined number of pulses of said oscillator output signal are counted wherein there are produced a plurality of count signals; and a plurality of switching elements, connected in parallel between said first interconnection and said second interconnection, said switching elements being sequentially turned on in response to said count signals.

3. The circuit according to claim 2, wherein said switching elements are MOS transistors.

4. The circuit according to claim 3, wherein said MOS transistors serve as resistors having a high resistance when turned on in response to said count signals.

5. The circuit according to claim 1, wherein said potential difference control circuit includes a switching element to be turned on in synchronism with a change in the output voltage, said switching element serving as a time constant circuit with a time constant defined by a capacitance and a resistance of itself when turned on.

6. The circuit according to claim 1, wherein said potential difference control circuit includes:

a switching element to be turned on in synchronism with a change in the output voltage; and a capacitor connected in series to said switching element, wherein said switching element and said capacitor form a time constant circuit defined by a capacitance of the capacitor and a resistance of the switching element when turned on.

7. A circuit for receiving a supply voltage from a power supply and generating an output voltage having a desired voltage level that is different from the supply voltage, said circuit comprising:

an oscillator for generating an oscillator output signal;

a supply voltage generator for generating an output voltage having a predetermined level that is different than said supply voltage in response to said oscillator output signal;

a first interconnection for connecting said supply voltage generator to a circuit to be supplied with said output voltage, said circuit being connected to the power supply via a second interconnection;

a counter circuit for counting pulses of said oscillator output signal, said counter circuit starting a counting operation in response to a strobe signal input when the output voltage of the supply voltage generator is to be changed from the predetermined level, and sequentially outputting a count signal every time a predetermined number of pulses of said oscillator output signal are counted wherein there are produced a plurality of count signals; and a plurality of switching elements, connected in parallel between said first interconnection and said second interconnection, said switching elements being sequentially turned on in response to said count signals; and a plurality of resistors, each resistor being connected in series to an associated one of said switching elements.

8. A semiconductor device for receiving a supply voltage from a power supply and generating a voltage of a desired level different from that of said supply voltage, said device comprising:

an oscillator for generating an oscillator output signal;

a supply voltage generator for generating an output voltage having a predetermined level that is different than said supply voltage in response to said oscillator output signal;

an internal circuit to be supplied with said voltage generated by said supply voltage generator;

a first interconnection for connecting said supply voltage generator to said internal circuit, said internal circuit being also connected to a power supply via a second interconnection; and a potential difference control circuit provided between said first interconnection and said second interconnection, the control circuit being responsive to said oscillator output signal to gradually reduce a potential difference between said first interconnection and said second interconnection in synchronism with a change in the output voltage.

9. The device according to claim 8, wherein said control circuit comprises:

a counter circuit for counting pulses of said oscillator output signal, said counter circuit starting a counting operation in response to a strobe signal input when the output voltage of the supply voltage generator is to be changed from the predetermined level, and sequentially outputting a count signal every time a predetermined number of pulses of said oscillator output signal are counted wherein there are produced a plurality of count signals; and a plurality of switching elements, connected in parallel between said first interconnection and said second interconnection, said switching elements being sequentially turned on in response to said count signals.

10. The device according to claim 9, wherein said switching elements are MOS transistors.

11. The device according to claim 10, wherein said MOS transistors serve as resistors having a high resistance when turned on in response to said count signals.

12. A semiconductor device for receiving a supply voltage from a power supply and generating a voltage of a desired level different from that of said supply voltage, said device comprising:

an oscillator for generating an oscillator output signal;

a supply voltage generator for generating an output voltage having a predetermined level that is different than said supply voltage in response to said oscillator output signal;

an internal circuit to be supplied with said voltage generated by said supply voltage generator;

a first interconnection for connecting said supply voltage generator to said internal circuit, said internal circuit being also connected to a power supply via a second interconnection;

a counter circuit for counting pulses of said oscillator output signal, said counter circuit starting a counting operation in response to a strobe signal input when the output voltage of the supply voltage generator is to be changed from the predetermined level, and sequentially outputting a count signal every time a predetermined number of pulses of said oscillator output signal are counted wherein there are produced a plurality of count signals;

a plurality of switching elements, connected in parallel between said first interconnection and said second interconnection, said switching elements being sequentially turned on in response to said count signals; and a plurality of resistors, each resistor being connected in series to an associated one of said switching elements.

* * * * *